US005977699A

United States Patent [19]

Joo et al.

[11] Patent Number: 5,977,699

[45] Date of Patent: Nov. 2, 1999

[54] CATHODE FOR ELECTRON TUBE

[75] Inventors: Kyu-nam Joo, Suwon; Jong-seo Choi, Anyang; Soo-chan Lee; Deuk-il Park, both of Suwon, all of Rep. of Korea

[73] Assignee: Samsung Display Devices Co., Ltd., Kyungki-do, Rep. of Korea

[21] Appl. No.: 09/005,007

[22] Filed: Jan. 9, 1998

[30] Foreign Application Priority Data

Aug. 7, 1997 [KR] Rep. of Korea ..... 97-37800

[51] Int. Cl.[6] ..... H01J 1/14

[52] U.S. Cl. ..... 313/346 R; 313/346 OL

[58] Field of Search ..... 313/446, 270, 313/346 R, 346 OL

[56] References Cited

U.S. PATENT DOCUMENTS 5,548,184 8/1996 Choi et al. ..... 313/346 R

*Primary Examiner*—Vip Patel

*Attorney, Agent, or Firm*—Leydig, Voit & Mayer, Ltd.

[57] ABSTRACT

A cathode for an electron tube, includes a base metal having nickel as a main component, and an electron emitting material layer containing an alkaline earth metal oxide having barium oxide as a main component, wherein a metal layer having zirconium as a main component is located between the base metal and the electron emitting material layer. The cathode has an excellent initial electron emitting characteristic and can emit a large quantity of electrons for a long time. Therefore, the cathode is suitable for a larger and higher-definition CRT.

7 Claims, 1 Drawing Sheet

CATHODE FOR ELECTRON TUBE

BACKGROUND OF THE INVENTION

The present invention relates to a cathode for an electron tube, and, more particularly, to a cathode for an electron tube having an increased lifetime to emitting a large quantity of electrons for a long time in a high current density area.

FIG. 1 is a schematic section view of a conventional cathode for an electron tube, having a disk-like base metal 2, a cylindrical sleeve 3 for rigidly supporting the base metal 2 from the bottom thereof, a heater 4 placed in the cylindrical sleeve 3 as a heat a source for heating the cathode, and an electron emitting material layer 1 coating the base metal 2.

The electron emitting material layer 1 is generally composed of an alkaline earth metal oxide having barium oxide as a main component, preferably a ternary metal oxide represented by (Ba, Sr, Ca)O.

Such an electron emitting material layer is formed as follows. First, a mixed powder of barium carbonate, strontium carbonate, and calcium carbonate is dissolved in an organic solvent to form a solution. Then, the solution is applied to on the base metal 2 by a process such as spraying or electro-deposition, to form a carbonate salt layer. Thereafter, the electron gun which the electron tube cathode is fixed is mounted in an electron tube and the carbonate salt layer is heated to about 1000° C. by means of a heater, during evaluation of the electron tube. At this time, the carbonate salt is turned into an oxide. For example, barium carbonate is turned into barium oxide as in the following reaction (1). For reference, the name "oxide cathode" is derived because a carbonate salt is changed into an oxide by heating the same at a high temperature during evacuation of the electron tube.

$$BaCO_3 \rightarrow BaO + CO_2\uparrow \quad (1)$$

The generated BaO reacts with a reducing agent Si or Mg, contained in the base metal 2 at the interface between the base metal 2 and the electron emitting material layer 1 during operation of the cathode, and is reduced to free barium, as in the following reactions (2) and (3).

$$BaO + Mg \rightarrow MgO + Ba\uparrow \quad (2)$$

$$4BaO + Si \rightarrow Ba_2SiO_4 + 2Ba\uparrow \quad (3)$$

The thus formed free barium is an electron emitter. However, in this process, MgO and $Ba_2SiO_4$ are generated and these materials form an intermediate layer at the interface between the electron emitting material layer 1 and the base metal 2. The intermediate layer acts as a barrier that interferes with diffusion of Mg or Si. Accordingly, it is difficult to generate free barium contributing to electron emission, which leads to undesirably reduced life time of the oxide cathode. Also, the intermediate layer has high resistance and prevents the flow of current for emission of electrons, which limits the current density.

According to a recent trend toward higher definition and larger screen display devices employing a cathode ray tube (CRT) devices, there has been an increasing need for a cathode having a high-current density and long lifetime. However, the conventional oxide cathode cannot fill this need, due to disadvantages with respect to performance and lifetime.

SUMMARY OF THE INVENTION

To solve the problems of the prior art, it is an object of the present invention to provide an electron tube cathode which can emit electrons for a long time in a high-current density.

To accomplish the above object, there is provided a cathode for electron tube comprising: a base metal having nickel as a main component; and an electron emitting material layer containing an alkaline earth metal oxide having barium oxide as a main component, wherein a metal layer having zirconium as a main component is formed between the base metal and the electron emitting material layer.

The metal layer may further comprise tungsten, nickel, molybdenum, or aluminum, preferably tungsten or nickel. The thickness of the metal layer is preferably 400~20,000 Å.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1:
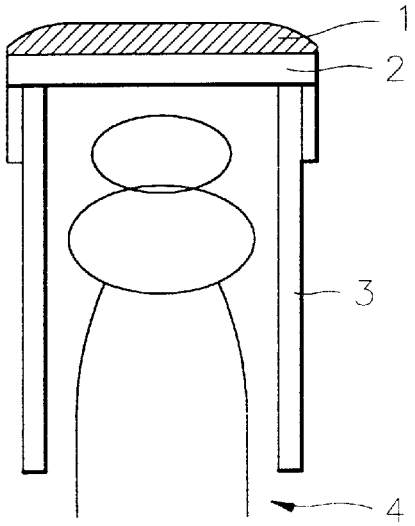
FIG. 1 (PRIOR ART)
FIG. 1 is a schematic section view of a conventional electron tube cathode.
Figure 2:
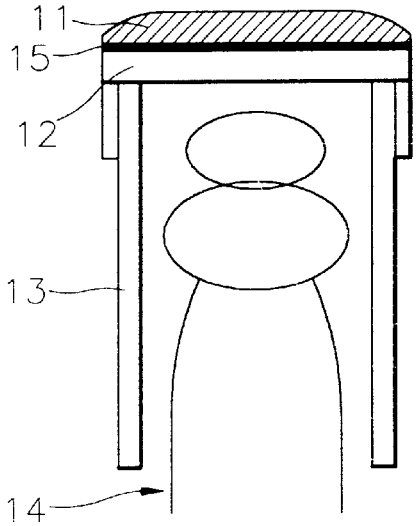
FIG. 2 is a schematic section view of an electron tube cathode according to the present invention.

In FIG. 2, reference numerals 11, 12, 13 and 14 correspond to reference numerals 1, 2, 3 and 4 shown in FIG. 1, respectively, and reference numeral 15 defines a metal layer which is a feature of the present invention. Zirconium (Zr) in the metal layer 15 is a reducing element, for form free barium. Zr has excellent reducing properties which improve an initial electron emitting characteristic and allow a large quantity of electrons to be emitted for a long time. The initial electron emitting characteristic is determined as a current called the "Maximum Cathode Current" (MIK), and a cathode lifetime characteristic is determined as the residual rate of the initial MIK after a given period.

The metal layer 15 is preferably formed using a sputtering method. In other words, the top surface of the base metal 12 is cleaned and then a Zr coating is thereon by sputtering. Then, the resultant structure is preferably thermally treated under an inert atmosphere or in a vaccum for diffusion or alloying of the base metal and the Zr layer. The metal disperses an intermediate layer at the interface between the base metal 12 and the electron emitting material layer 11, which allows the reducing agent to be smoothly supplied for a long time. The thermal treating temperature is preferably 700~1,200° C.

According to a preferred embodiment of the present invention, the metal layer 15 may further include tungsten (W), nickel (Ni), molybdenum (Mo), or aluminum (Al). In this case, a metal layer further including another metal in addition to Zr may be formed by using a Zr target and another metal target. For example, a metal layer including Zr and W may be formed using a W target and a Zr target. A thermal treatment is necessary after the sputtering process. This is because the two metals concurrently existing on the base metal by the sputtering process must be alloyed and diffused. The thermal treating temperature is preferably 700~1,200° C. Also, the weight ratio of Zr to at least one of W and Ni is preferably 3:7 to 7:3.

After the metal layer 15 is formed, a carbonate salt layer is applied to form the electron emitting material layer 11 containing an alkaline earth metal oxide. The electron emitting material layer may further include a lanthanum (La) compound and a magnesium (Mg) compound, as well as the alkaline earth metal oxide, such as a ternary coprecipitated oxide (Ba, Sr, Ca)O. Particularly, the La compound and the Mg compound preferably exist in the form of an La—Mg composite compound. Also, the ternary coprecipitated oxide (Ba, Sr, Ca)O may be replaced by a binary coprecipitated oxide (Ba, Sr)O.

The total content of La and Mg contained in the electron emitting material layer is preferably 0.01~20 wt % with respect to the alkaline earth metal oxide. If the content is less than 0.01 wt %, the increase in lifetime is insignificant. However, if the content is greater than 20 wt %, the initial characteristics are degraded. Also, the mole ratio of La to Mg is preferably 1:3.5 to 1:4.5.

Hereinbelow, preferred embodiments of the present invention will be described in detail, but the invention is not limited thereto.

EXAMPLE 1

A base metal was manufactured using an alloy comprised of Ni, 0.05 wt % of, and 0.05 wt % of Mg with respect to the Ni. One surface of the base metal was attached to a sleeve. Zr and W were applied to the base metal in a weight ratio of 7:3, by sputtering using a Zr target and a W target. The resultant structure was thermally treated at 950° C. for 10 minutes to form a 2000 Å thick metal layer.

Figure 3:
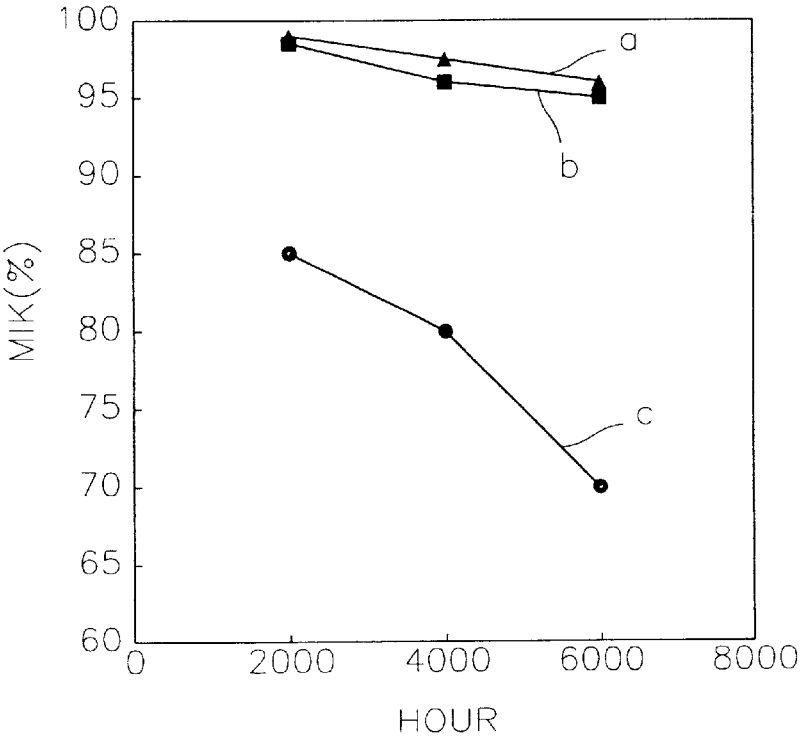
FIG. 3 is a graph for comparing lifetime characteristics of the electron tube cathode according to the present invention and the conventional one.

$Ba(NO_3)_2$, $Sr(NO_3)_2$, and $Ca(NO_3)_2$ were dissolved in pure water and then coprecipitated using $Na_2CO_3$ to manufacture a ternary coprecipitated carbonate salt. A coating solution, in which the ternary coprecipitated carbonate salt was dispersed in a liquid lacquer, was applied to the metal layer and dried. The sleeve including the base metal, the metal layer and the carbonate salt layer was inserted into and fitted within an electron gun. Then, a heater for heating the cathode was inserted and supported within the sleeve. The electron gun was sealed in a bulb an for electron tube that was evaluated to create an internal vacuum. Thereafter, an electron tube was manufactured by a conventional method and the lifetime and initial emission characteristics thereof were measured, which are shown in FIG. 3 (curve "a"). The measurement was performed for 6000 hours and a high current of 2000~3000 $\mu$A was maintained for the cathode.

EXAMPLE 2

With the exception of the metal layer being formed only of Zr, a cathode was manufactured in the same manner as described in Example 1. Then, the lifetime and initial emission characteristics were measured. The results are shown in FIG. 3 (curve "b").

COMPARATIVE EXAMPLE

With the exception of no metal layer being formed, a cathode was manufactured in the same manner as described in Example 1. Then, the lifetime and initial emission characteristics were measured and the results thereof are shown in FIG. 3 (curve "c").

As can be seen from FIG. 3, an oxide cathode having a metal layer between a base metal and an electron emitting material layer, according to the present invention, has excellent initial electron emitting characteristic, compared to a conventional cathode, and the drop-off of the electron emission amount according to long use is small.

As described above, the electron tube cathode according to the present invention has an excellent initial electron emission characteristic, and a large quantity of electrons is emitted for a long time. Therefore, the cathode according to the present invention is suitable for a larger and higher-definition cathode ray tube.

What is claimed is:

1. A cathode for electron tube comprising a base metal having nickel as a main component and an electron emitting material layer containing an alkaline earth metal oxide having barium oxide as a main component, wherein a metal layer having zirconium as a main component is located between said base metal and said electron emitting material layer.

2. The cathode as claimed in claim 1, wherein said metal layer is 400~20,000 Å thick.

3. The cathode as claimed in claim 1, wherein said metal layer further comprises at least one metal selected from the group consisting of tungsten (W), nickel (Ni), molybdenum (Mo), and aluminum (Al).

4. The cathode as claimed in claim 3, wherein the weight ratio of Zr to at least one metal selected from the group consisting of W and Ni is 3:7 to 7:3.

5. The cathode as claimed in claim 1, wherein said electron emitting material layer includes a lanthanum (La) compound and a magnesium (Mg) compound.

6. The cathode as claimed in claim 5, wherein the total content of La and Mg is in the range of 0.01–20 wt %, based on said alkaline earth metal oxide.

7. The cathode as claimed in claim 5, wherein the mole ratio of La to Mg is 1:3.5~1:4.5.

* * * * *